US010902833B2

(12) United States Patent
Solow

(10) Patent No.: US 10,902,833 B2
(45) **Date of Patent: *Jan. 26, 2021**

(54) ADAPTIVE ELECTROPNEUMATIC HORN SYSTEM

(71) Applicant: WOLO MFG. CORP., Deer Park, NY (US)

(72) Inventor: Stanley Solow, Plainview, NY (US)

(73) Assignee: WOLO MFG. CORP., Deer Park, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/888,710

(22) Filed: May 30, 2020

(65) Prior Publication Data

US 2020/0302905 A1 Sep. 24, 2020

Related U.S. Application Data

(63) Continuation of application No. 16/478,879, filed as application No. PCT/US2018/015130 on Jan. 25, 2018, now Pat. No. 10,726,823.

(60) Provisional application No. 62/450,803, filed on Jan. 26, 2017.

(51) Int. Cl.

| | |
|---|---|
| ***G10K 9/04*** | (2006.01) |
| ***G10K 9/12*** | (2006.01) |
| ***G10K 9/22*** | (2006.01) |

(52) U.S. Cl.

CPC ..... *G10K 9/04* (2013.01); *G10K 9/12* (2013.01); *G10K 9/22* (2013.01)

(58) Field of Classification Search

CPC ..... G10K 9/04; G10K 9/12; G10K 9/22

See application file for complete search history.

(56) References Cited

U.S. PATENT DOCUMENTS

| | | | |
|---|---|---|---|
| 5,071,100 | A | 12/1991 | Sweeney |
| 6,294,984 | B1 | 9/2001 | Meisier |
| 2010/0154699 | A1 | 6/2010 | Woods et al. |
| 2014/0009272 | A1 | 1/2014 | Righetto |
| 2014/0093112 | A1 | 4/2014 | Solow |

OTHER PUBLICATIONS

PCT/US18/15130 filed Jan. 25, 2018.
U.S. Appl. No. 62/450,803, filed Jan. 26, 2017.
Utility U.S. Appl. No. 16/478,879, filed Jul. 18, 2019.
.PCT/US2018/015130, International Search Report and Written Opinion dated Sep. 5, 2018, 12 pages—English.

*Primary Examiner* — Thomas S McCormack
(74) *Attorney, Agent, or Firm* — Andrew F. Young, Esq.; Nolte Lackenbach Siegel

(57) ABSTRACT

An adaptive electropneumatic horn system include an acoustic sound wave generator including an acoustic duct chambering system. The Acoustic sound wave generator receives compressed air remotely from a compressor member to produce sound and propagate the same externally. A horn mounting system enables ready attachment and fitment of the system to a remote consumer-desired location and is adaptive to constraining geometries and locations greatly spacing the acoustic sound wave generator from the compressor member, and as a result a plurality of fitment features provided in the horn mounting system allow positioning to a user's preference, within increased safety and reliability. An adaptive mounting bracket member additionally securely receives the air compressor unit.

8 Claims, 8 Drawing Sheets

ADAPTIVE ELECTROPNEUMATIC HORN SYSTEM

CROSS REFERENCE TO RELATED APPLICATIONS

This application relates to, and claims priority as a continuation (CON) of U.S. Ser. No. 16/478,879 filed Jul. 18, 2019, which in turn claims priority as a § 371 from PCT/US2018/015130 filed Jan. 25, 2018, which in turn claims priority from U.S. Ser. No. 62/450,803 filed Jan. 26, 2017, the entire contents of each of which are incorporated herein fully by reference.

FIGURE SELECTED FOR PUBLICATION

FIG. 2B

BACKGROUND OF THE INVENTION

Field of the Invention

The present invention relates to an electropneumatic air horn system. More particularly, the present invention provides an electropneumatic air horn system that is adaptive to a plurality of fitment and adaptive positions and fixing locations for vehicle and non-vehicle uses.

Description of the Related Art

The related art involves generally electric and electropneumatic horn constructions and systems. Electropneumatic horns are those which generate sound by generated air flow or compressed air and are considered (very broadly due to their typical electrical operation of compressed air or air-supply valving) to be within the wider grouping of electric horns due to the electric control of the generation of the air flow or compressed air. It should be noted that electric horn constructions also include (in addition to pneumatic sound creation) the creation of electronic sound (e.g. speaker type systems) wherein sound or tone is the result of a replay of a recorded electronic signal to a speaker and not the result of an acoustic passage. As a consequence, those of skill in the art will recognize that the use of the phrases electronic, electrical, and electropneumatic shall be considered non-limiting in the following description absent specific use in the particular claims.

Conventionally, electropneumatic horns include acoustic units consisting of a straight tube sound-passage of a length related to the frequency to be reproduced, inserted in an acoustic chamber in which a membrane free to move with a reciprocating motion is arranged and positioned. Also, the straight tube comprises a first stretch with a generally constant cross-section, provided with an inlet mouth for the sound signal generated by the oscillating membrane and a second stretch having a section varying with a generally conic or frustoconic ending with an outlet mouth for the amplified sound signal (e.g., horn shaped).

As used in these conventional electropneumatic horns, the membrane is stretched or positioned during a pre-assembly calibration phase by deformation against the membrane of a member referred to as a 'sound generator' and applied to a chamber body, in such a way to generate a sound with manufacturer-desired predetermined acoustic pressure. In an alternatively constructed versions of the related art, the acoustic units are created in a bi-tonal (two vibrating membranes) or mono-tonal (one vibrating membrane) manner and the corresponding tubes are volute wound and juxtaposed to limit the overall dimensions of the horn allowing for reduced-size installations for an entire rigid assembly.

Industrial applications of monolithic electropneumatic horn systems are know from the applicant's and inventor's prior patents, including, but limited U.S. Pat. Nos. 9,318,087, 7,712,430, 7,802,535, 7,938,078, and U.S. D611,864 (all by the present inventor/applicant), the entire contents of each of which are incorporated by reference. Electronic tonal notes created digitally are also known from U.S. Pat. No. 6,489,885 (by the inventor).

As noted in these related references, electropneumatic horn assemblies provided a substantial and numerous improvements over U.S. Pat. No. 7,038,756 (DiGiovani et al.), the entire contents of which are also incorporated herein by reference.

Collectively, the focus of the above-noted conventional references was to securely join acoustic sound wave generator with a compressor assembly in a reliable matter in view of the grave detriments and challenges known in the art. The construction in the '756 patent failed under substantive vibratory use and has been a commercial failure. The commercial success of the products as patented by Solow (noted above) with a monolithic housing provided great reliability and a substantial improvement over the art.

In considering the conventional art, as noted under U.S. Pat. No. 7,038,756 (DiGiovani et al.), reference is now made to FIG. 1. Referring now also to U.S. Pat. No. 7,712,430, the entire contents of which are again noted as incorporated by reference, applicant has attempted to respond to the needs in the art by providing a dual tone or dual acoustic unit wherein a conventional electropneumatic assembly 1 accommodates dual acoustic units having respective horn openings 4A and 4B within a relatively compact housing 2. In this housing 2 contains a single non-removable compressor unit 6, or compressor member 6 which is fixably joined to the housing 2, and provides a compressed air supply via an internal air supply outlet passage and fixture 13 simultaneously to each acoustic unit within housing 2 via internal chambering (not shown).

As also noted, dual opposing diaphragm units 3 (front as shown) and 3 (rear side is not shown) respectively receive, via internal chambering (not shown, but visible in the '756 patent) compressed air from compressor unit 6 via respective diaphragm air supply portals 16 (front) and 16 (rear) (the reverse side is not shown). Diaphragm units 3 (front) and 3 (rear) (not shown), operate as sound generators and transmit the sound to the volute acoustic chambers respectively connecting each diaphragm unit 3 to respective horn openings 4A and 4B.

Compressor unit 6 includes an operable motor housing member 14 formed from a very rigid metal body, a bottom electric brush housing member 10, wherein electrical power is received via power supply wires 5, and a top compressor labyrinth member 9. As will be noted from FIG. 1, rigid housing member 14 includes folded metal tabs 15 (one is shown) serving as fixing engagement fingers joining motor housing 14 to a top compressor labyrinth member 9 to prevent unintended separation and reliable operation of compressor unit 6. Typically, the electrical brush holder at member 10 is secured to rigid housing member 14 via a plurality of fixing members (not shown). Unfortunately, the ease of assembly for this device also creates relative structural weaknesses in the overall completed assembly 1 that may serve as a source of future failure (as is discussed) particularly in high vibration environments.

Housing 2 includes a pair of opposing C-shaped plastic clamp arms 7A and 7B as shown for fixably gripping portions of the external surface of rigid housing member 14. Additionally, an air pathway member 11, having an air intake opening 12 is formed along the wall of the first clamp arm 7A and supplies air to the top air opening or inlet (not shown) in compressor to member 9. Additionally, a single mounting bracket member 17, extends cantilevered rearwardly from compressor unit 6 and compressor pump member 9, allowing attachment to a location typically within an engine compartment or wall (e.g., a dry location, not shown). As noted earlier, system 1 contains a number of relative structural weaknesses, and mounting bracket member 17 is a common location for structural failure and further fails to adapt to numerous locations and surfaces. As can be recognized from the cantilever projection construction shown from compressor labyrinth 9, mounting bracket 17 provides a single-site attachment mechanism, which have been proven to fail when used in high-vibration environments, including automotive and motorcycle mounting environments.

Additionally, it shall be recognized by those of skill in the art that opposing paired clamping arms 7A and 7B slidingly receive compressor unit 6 during initial assembly, and consequently that even with air outlet fixture 13 providing an additional engagement with housing 2, the construction taught in '576 often results in mechanical failure causing separation of compressor unit 6 because there is no physical engagement between the body of the compressor unit 6 and housing 2 other than air outlet fixture 13, and, because there is no mechanism to maintain the tension between clamp arms 7A and 7B to ensure and maintain a clamping pressure, particularly during the thermal expansion common in plastic housings when employed in high temperature environments common in vehicle wall mounting positions. As a consequence of this tendency for mechanical failure, those who review the mechanical units marked with the '576 patent note the inclusion of an additional adhesive double-tape stick portion between clamp arm members 7A and 7B and portions of the wall surfaces of motor housing 14.

The applicant's numerous prior patents addressed these concerns, and others. However, the related art fails to provide an adaptive mounting system with a monolithic sound wave generator and remote provided compressor.

Additionally, the concerns of the convention art force a combined compressor and horn assembly to necessarily have a cantilevered attachment system away from a fixed mounting point. The conventional art recognizes such an extreme vibration detriment. Additionally, due to the extensive weight of the compressor and motor, this cantilevered arrangement causes an excessive bending moment on the entire housing during engine vibration and road vibration. As a result, a common failure in the conventional art is that the plastic housing stress-fractures or initially fractures and the vibration and weight (weigh enhancing the force of the vibration motive force) quickly extends any initial fracture to a complete fracture causing horn mounting and sound functions to fail. Such exposed members, suddenly fractured, create extensive vehicle-safety and user-safety hazards.

As an additional detriment, the conventional art forces the co-location of both the horn and the compressor units in a fixed-assembly to ensure that the maximum force of compressed air is delivered from the compressor to the horn by elimination of connection points, and to also position the horn source in a user-convenient-position. These concerns cause a number of complementary concerns, including, but not limited to the need to locate the compressor (an electrical device) in a weather-exposed and moisture-exposed and vibration-exposed location causing failures.

Additionally, the conventional arts require that the combined compressor and horn assembly systems be exposed to weather that additionally detrimentally harms the horn assembly portion. Exposed horn trumpets are at risk of moisture, road-dirt, grime damage creating a negative impact in performance and possibly totally disabling the horn.

Accordingly, there is a need to respond to at least one of the concerns noted herein.

ASPECTS AND SUMMARY OF THE INVENTION

In response, it is now recognized that the invention provides an adaptive electropneumatic horn system include an acoustic sound wave generator including an acoustic duct chambering system. The Acoustic sound wave generator receives compressed air remotely from a compressor member to produce sound and propagate the same externally. A horn mounting system enables ready attachment and fitment of the system to a consumer-desired location which allows positing to a user's preference and is adaptive to constraining geometries and remote locations greatly spacing the acoustic sound wave generator from the compressor member, and as a result a plurality of fitment features provided in the horn mounting system allow positioning to a user's preference.

In one aspect of the present invention there is provided an adaptive electropneumatic horn system, comprising, an electric compressor unit having at least a compressor air inlet and a compressor air outlet for the supply of compressed air and having a first mass; a monolithic housing assembly having a first housing portion and a sound wave generator system substantially housed in the first portion and having a second mass; the sound wave generator system including: at least one acoustic chamber having an opening for introduction of compressed air, a membrane member provided with an opening for sound generation and at least one acoustic duct housed in the housing assembly and communicating between the at least one acoustic chamber and at least one horn outlet to propagate sound generated by the membrane member outside the horn; remote air channeling means for communicating the compressed air between the compressor air outlet of the compressor unit and the opening of the at least one acoustic chamber; and means for securely affixing the electric compressor unit distant and the first mass distant from the monolithic housing assembly having the second mass, whereby the means for securely affixing prevents and the remote air channeling means position the electrical compressor unit and the monolithic housing assembly distant from each other and improves operational stability of the housing assembly.

According to another adaptive and alternative embodiment of the present invention there is additionally provided a securing bracket having an effective shape to secure a compressor against detrimental vibration in a variety of locations.

According to another adaptive and alternative embodiment of the present invention, there is provided, an adaptive electropneumatic horn system and the electric compressor unit is of a cylindraceous external configuration.

According to another adaptive and alternative embodiment of the present invention, there is provided an adaptive electropneumatic horn system, further comprising: a horn covering member shaped to receive therein the monolithic housing assembly and the sound wave generator system substantially housed in the first portion; the monolithic housing assembly including adjustable fixing means for securely affixing the monolithic housing and the sound wave generator to the horn cover.

In another aspect of the present invention there is provided a system that allows a convenient location of a compressor in a weather-protected and moisture-protected and dust-free location of a vehicle or motorcycle (for example in a saddle bag location or other bounded-volume-region) so as to avoid damage during inclement weather, vehicle washing, and vehicle maintenance, and off-road driving. It will be understood that one alternative and preferred embodiment is use on a motorcycle.

It is another aspect of the present invention the system allows for secure location of a compressor member and assembly in a secure manner linked to a secure location of a vehicle so as to eliminate the affect of vehicle engine or road vibration on the compressor. Additionally, the separation of the compressor assembly from the horn assembly eliminates the detrimental cantilevered The above and other aspects, features, and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
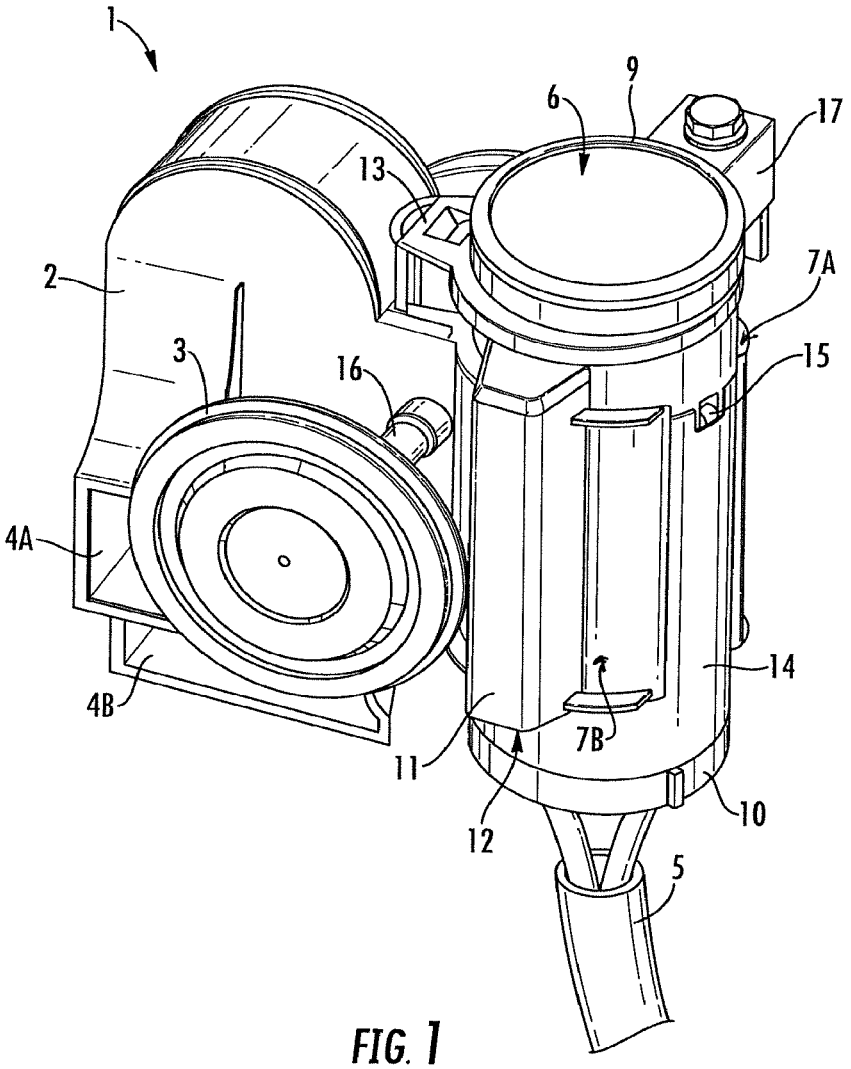
FIG. 1 PRIOR ART
FIG. 1 is a front perspective view of a conventional combined electropneumatic horn assembly.

Reference will now be made in detail to embodiments of the invention. Wherever possible, same or similar reference numerals are used in the drawings and the description to refer to the same or like parts or steps. The drawings are in simplified form and are not to precise scale. The word 'couple' or 'connect' or similar terms do not necessarily denote direct and immediate connections, but also include connections through intermediate elements or devices. For purposes of convenience and clarity only, directional (up/down, etc.) or motional (forward/back, etc.) terms may be used with respect to the drawings. These and similar directional terms should not be construed to limit the scope in any manner. It will also be understood that other embodiments may be utilized without departing from the scope of the present invention, and that the detailed description is not to be taken in a limiting sense, and that elements may be differently positioned, or otherwise noted as in the appended claims without requirements of the written description being required thereto.

Various operations may be described as multiple discrete operations in turn, in a manner that may be helpful in understanding embodiments of the present invention; however, the order of description should not be construed to imply that these operations are order dependent.

Referring now to FIGS. 2 through 8B, wherein an adaptive electropneumatic assembly 100A (FIG. 2A) or 100B (FIG. 2B), is positioned on a use vehicle 100 shown as a motorcycle having two opposed cylinder housings 101A, 101B, providing a difficult and small location 101C therebetween for positioning assembly 10A. It will be understood that adaptive electropneumatic assembly 10A accommodates single or dual acoustic units having respective horn openings 40A and 40B of a horn system 40 of a greater horn assembly or acoustic sound wave generator 30 within a relatively compact housing 42 for secure positioning within small location 101C or other small locations. In operable communication with compact housing 42 is a single compressor unit, or compressor member 20 which is spaced distantly from compact housing 42 as shown in different adaptive embodiments, and provides a compressed air supply via an extended air supply outlet hose 21 as an air channeling means simultaneously to one or more sound chambers or acoustic units within compact housing 42 via internal chambering. It is also noted that compressor assembly 20 is in communicating control to both a power source (not shown, such a vehicle (motorcycle, car, etc.) battery or other power supply) and to an operating control switch or control trigger (not shown, such as a horn button) via power supply source links (wires) 22A, 22B, respectively (on compressor 20) and optionally on to horn unit 40 via a horn unit source link/switch connection 22C (see FIG. 4).

As also noted, diaphragm units 33 (front as shown) and 33 (rear is not shown) or acoustic units or one or more sound chambers respectively receive, via internal chambering (not shown), but in communication with air hose 21 via air hose flange 20A receives compressed air from compressor assembly 20 provide air for sound via respective diaphragm air supply portals 36 and 36 (the reverse side is not shown). Diaphragm units 33 and 33 (not shown), operate as sound generators and transmit the sound to the volute acoustic chambers respectively connecting respective acoustic units or sound chambers or diaphragm units 33, 33 to respective horn openings 40A and 40B.

Compressor assembly 20 includes an operable motor housing member 24 formed from a very rigid metal body, a conventional bottom electric brush housing member 10, wherein electrical power is received via power supply source wire 22A, and a top compressor labyrinth member 29 receives air via air intake portal 29A from air intake system 32. As will be noted from FIG. 2, rigid housing member 24 includes (not shown) fixed connections engagement fingers joining motor housing 24 to top compressor labyrinth member 29 to prevent unintended separation and reliable operation. An air intake opening system 32 having an access opening 32A provides air to compressor labyrinth 29 along the body line of motor housing 24 in a convenient manner to allow an intake of air to be compressed for use with the horn.

Typically, bottom electronic brush housing member 10 is secured to rigid housing member 24 via a plurality of fixing members (not shown), threaded bolts, spring clips or other reliable means to secure fixidly.

Housing 42 of horn system 40 and acoustic sound wave generator 30 is formed as a continuous monolithic molded member to provide enhanced robustness and rigidity, and for adaptive mounting as will be discussed. As noted, a horn mounting system 50 is not limited to the components herein, but will be understood to include further or different fixtures, brackets, zip-ties, wires, tape, slide brackets or adjustable brackets or other elements required to achieve the functions as noted herein.

Horn mounting system 50 includes an integrally molded top sliding channel 51A (on a top side of compact housing 42 (FIG. 4, 5)) or an integrally molded side sliding channel 51B (on the side of compact housing (FIG. 7), or both. It will be understood that sliding channels 51A, 51B may be in any suitable profile or form shape to function as securing systems that are integrally molded into the compact housing 42 without limitation to the shapes shown in the present embodiment.

In the preferred but non-limiting embodiments noted, sliding channels 51A, 51B are formed in a T-shaped manner to cooperate with, as a non-limiting example, a carriage bolt or bolts, or respective threaded T-bolts 52A (top) 52B (side) and respective securing threaded nuts 53A (top) and 53B (side) as tensioning members or compressive members for use in compressively fixing and securing a projecting fitment 54A (top) 54B (side) to compact horn housing 42, as shown. It will be understood that with that with the proposed construction, fitments 54A, 54B may be pivoted easily about the threaded axis of respective threaded T-bolts 52A, 52B in a complete circle. It will be also noted that respective fitments 54A, 54B are provided with a plurality of fixing openings 55 along a length thereof so that any necessary spacing may be provided between a securing bracket 102 or other mounting location. Additionally, it will be understood that fitments 54A, 54B, and the related hardware may be inelastically bent (by hand or formed into a convenient shape) to fit about a vehicle frame member (shown for example as in FIG. 2A) to provide a close and reliable fitment for the entire adaptive electropneumatic horn system 100A, 100B.

Additionally, as is noted in exemplary FIGS. 4-7, one or both of fitments 54A, 54B and related components may be used to securely restrain horn assembly 40 to a frame member of a vehicle or in other manners discussed in the art.

Returning now to FIG. 3, it is noted that a mounting bracket 102 is provided for convenient securement of the adaptive invention, and also secure fitment of a decorative and protective horn assembly cover 300, here shown as an inverted U-shape providing weather and splash and contact damage resistance during a use. As will be noted in FIG. 3, horn cover 300 may be co-mounted to vehicle 100 using the same projecting threaded stem 103 between cylinder housings 101A, 101B, or horn cover 300 or an adaptive decorative horn cover 300A (see FIGS. 8A, 8B) and horn system 40 may be jointly assembled within horn covers 300, 300A as will be further discussed which allows room for power connection 22C. No prior arrangement allows for the compact positioning of sound generator horn system 40 to be positioned within horn cover 300, 300A with separately positioned air supply (as shown in this invention).

Figure 8A:
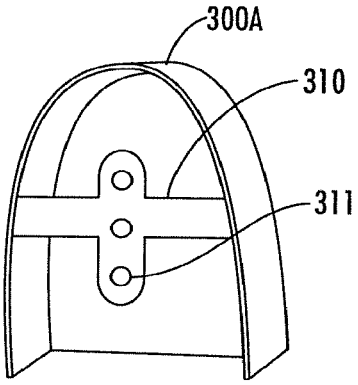
FIG. 8A is a rear perspective view of a decorative horn cover (as shown in FIGS. 2A, 2B, 3, and 8B illustrating adaptive mounting structures.
Figure 8B:
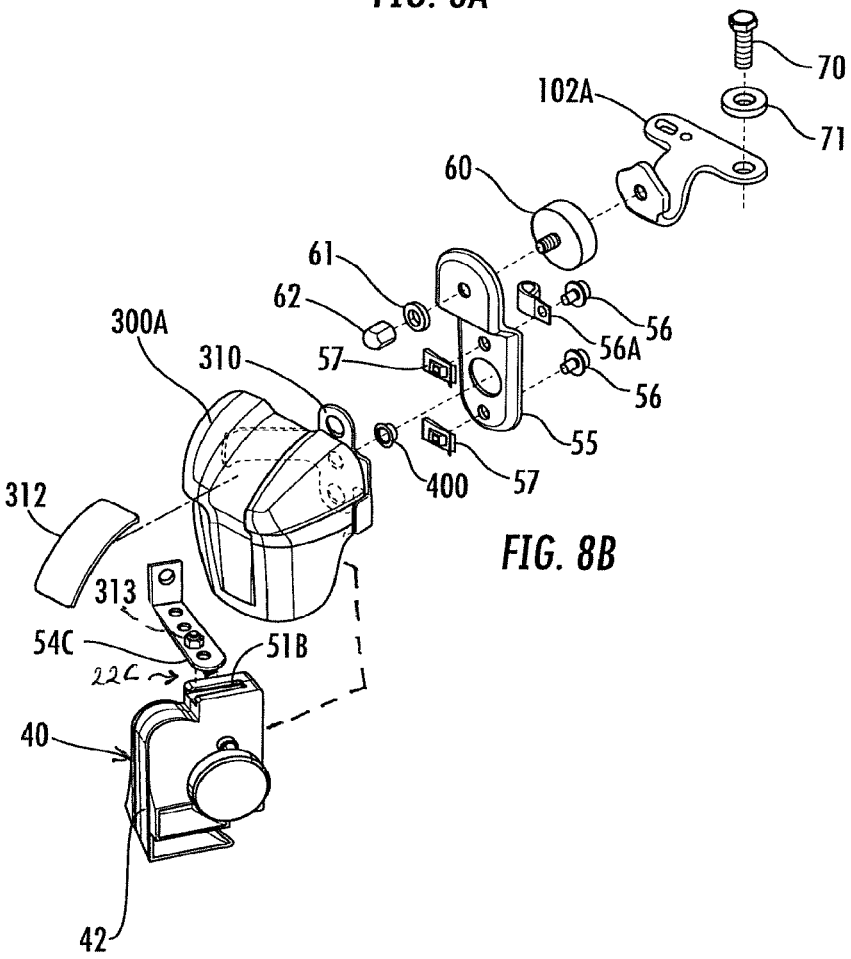
FIG. 8B refer to perspective illustrative and expanded illustrative views of a horn cover assembly where the cover includes integrally a rear molded bracket for joining a horn assembly to a horn cover and then to a vehicle frame.

Referring now additionally to FIGS. 8A and 8B, an alternative horn cover 300A is provided with a rear-securing fitment 310 with a plurality of fitment holes 311, 311, 311 or as may be otherwise provided. FIG. 8A is a rear perspective view of horn cover 300A noting the extending of fitment 310 from the rear portion thereof. In this form, it will be understood that a bracket, such as securing bracket 102A (FIG. 8B) may secure horn cover 300A to a vehicle 100 within the scope and spirit of the present invention. Therefore, as suggested in FIG. 8B, a molded horn cover 300A is provided with an extending rear-securing fitment 310 and optionally with a front ornamental bracket member 312 which may be used for any user-desired indicia. Therefore, it will be understood that in the present embodiment horn system 40 is secured within horn cover 300A without departing from the scope and spirit of the present invention. As a non-limiting example, a fitment member 54C is inverted (to place a bottom bracket downwardly toward horn openings) and secured in top vent 51B, and fitment member 54C is provided with extending threaded bolt member 313 extending therefrom to engage a threaded member 400 through an extending bracket 55, as shown. As a result, extending bracket 55 is secured to both fitment bracket 310 and horn cover 300A in a secure manner. Since the mass or weight of horn system 40 is very small (without the compressor) there is very little vibration moment or motion, and therefore very little force exerted on horn system 40 for breakage.

As will be further understood, fitment bracket 310 may be secured to bracket 55 using threaded bolts 56, 56 with corresponding vibration resistant spring lock washer members 57, 57 to fixably secure fitment bracket 310, and horn cover 300A, and therefore horn system 40 together in a unitary body.

As will be further understood from review, bracket 55 may be additionally secured to an optional vehicle mounting bracket 102A (FIG. 8B, shown in a bent configuration vs. bracket 102 in FIG. 3), using a threaded member 60, here shown with a vibration resistant cushion such as rubber or an elastomeric cover, and a washer 61 and a threaded cap 62, such that mounting bracket 102A may be correspondingly fixed via a bolt 70 and washer 71 to vehicle 100 to provide an enhanced and secure connection.

It will be understood that the compressor assembly and compressor member may be understood interchangeably as the compressor assembly 20 generates compressed air for delivery to a horn assembly or acoustic sound wave generator system 40, there is an additional enhanced benefit from the present invention. In the proposed invention, air hose 21 with or without a protective cover extends directly from air output 20A of compressor 20 to compact housing 42 via a rear-access portal 43 (see FIG. 3) and may be secured thereto by a wire or hose clamping member 56A (FIG. 8B) to receive wires from power connection 22C and avoid an unintentional disconnectment. It should also be understood that there is no limitation on the location of the air input port 20A, which may be presented on any suitable surface sufficient for air communication. In sum, there is a continuous compressed air communication from remote compressor assembly 20 to compact housing 42, and any respective horn. E.g., for example wire clamping member 56A (FIG. 8B) secures a wire connection from power connection 22C port on the back of horn system 40 whereas the same shape 56A (now as a hose clamping member 56A) may be used to connect air-hose 21 or power wires 22A, 22B to other locations on vehicle 100.

Figure 2A:
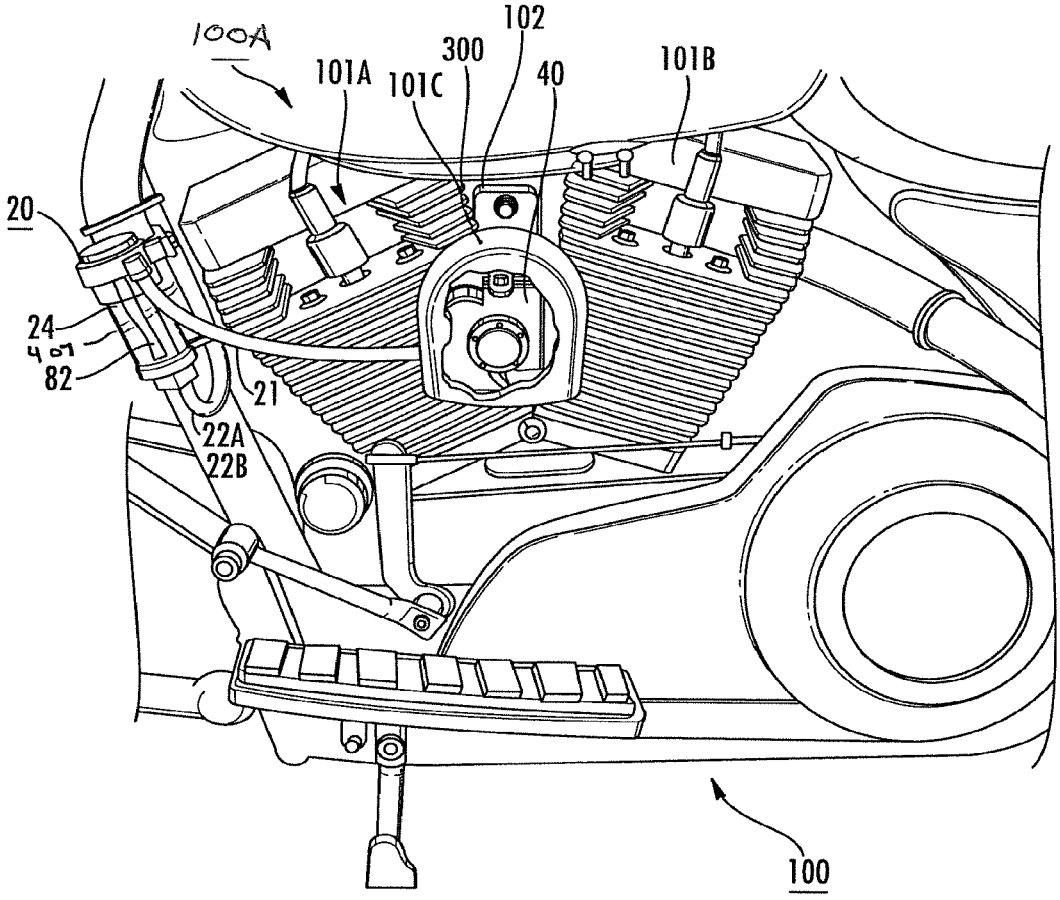
FIG. 2A is perspective illustrative view of an alternative adaptive electropneumatic horn system according to one aspect of the present invention.
Figure 2B:
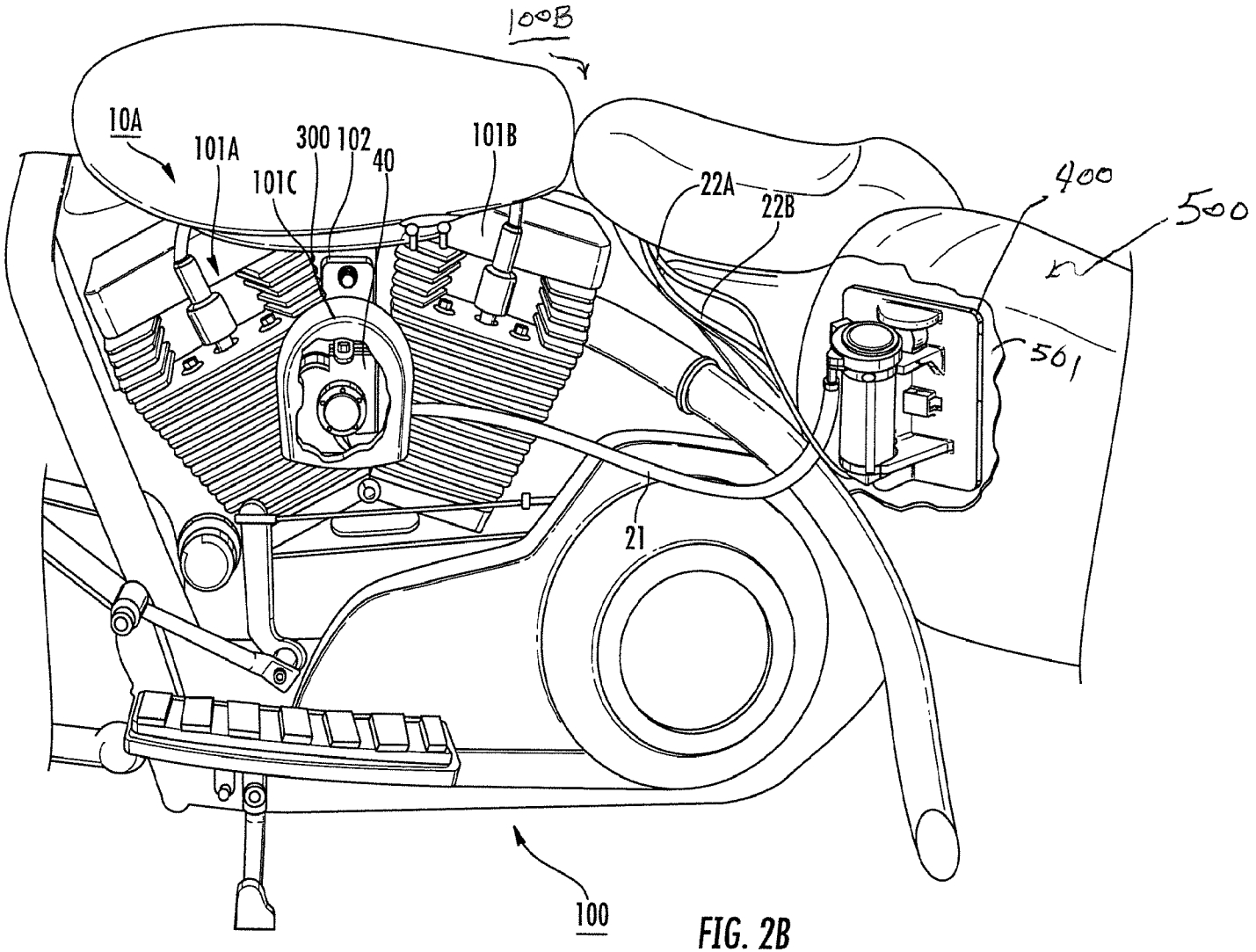
FIG. 2B is a perspective illustrative view of another alternative adaptive electropneumatic horn system according to another aspect of the present invention.
Figure 2C:
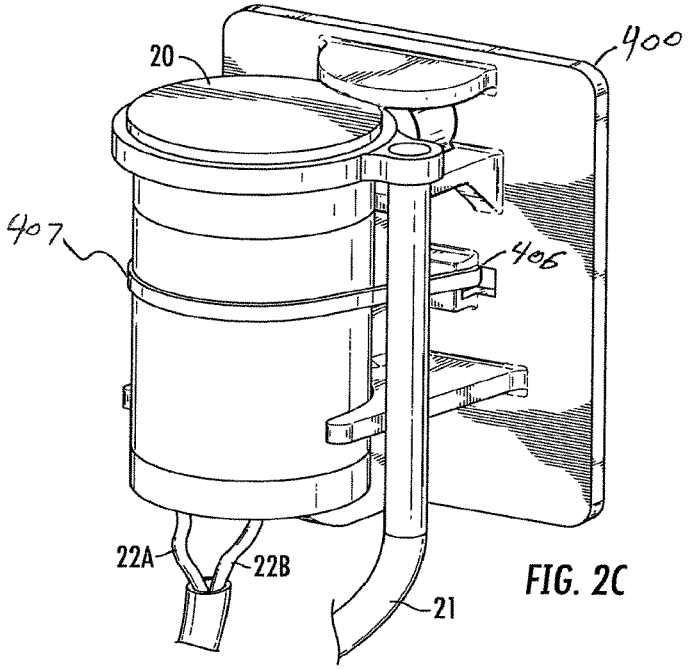
FIG. 2C is a perspective view of a mounting bracket member for use in another adaptive electropneumatic horn system according to another aspect of the present invention.
Figure 2D:
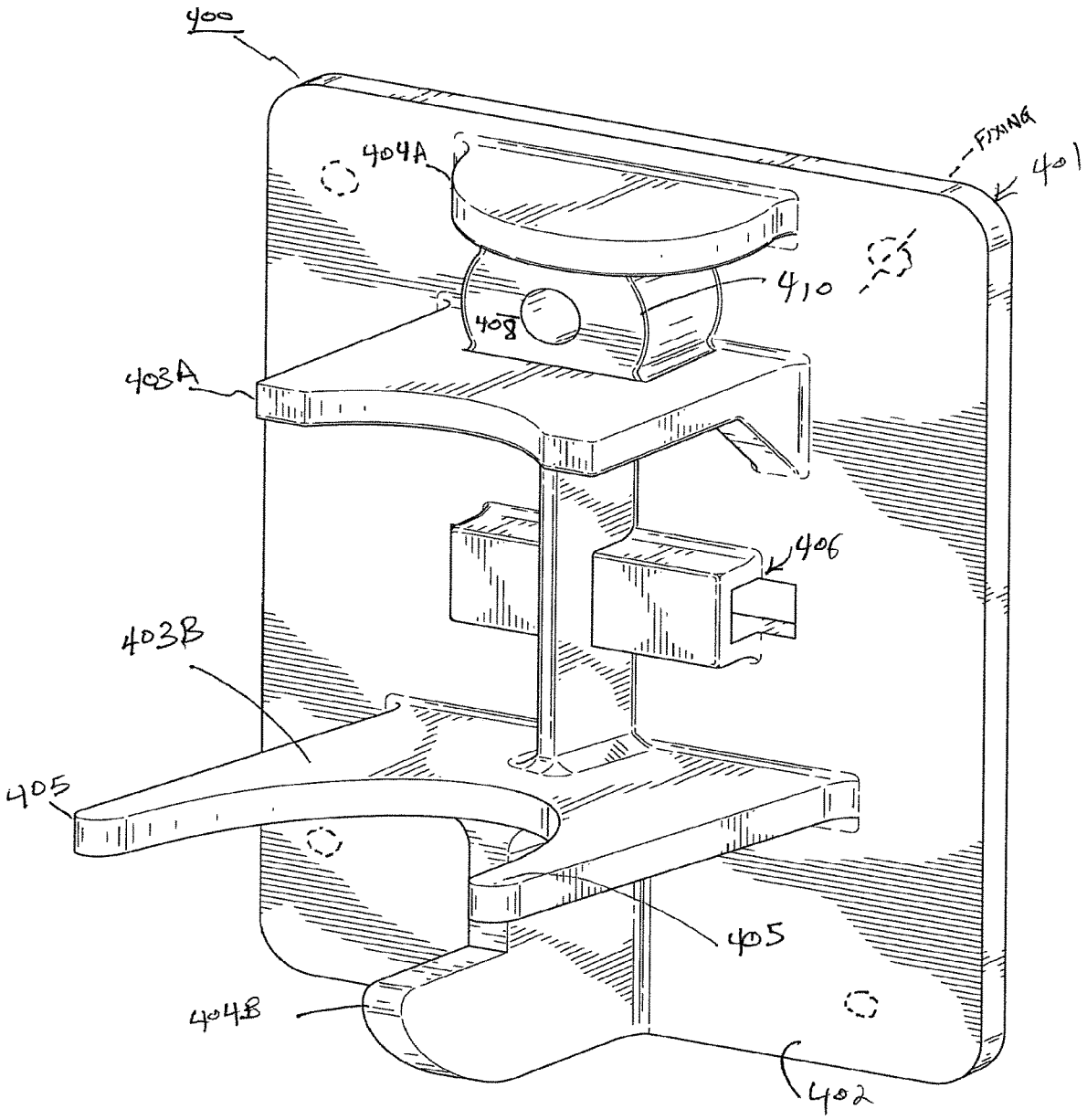
FIG. 2D is a perspective view of the mounting bracket in FIG. 2C.
Figure 4:
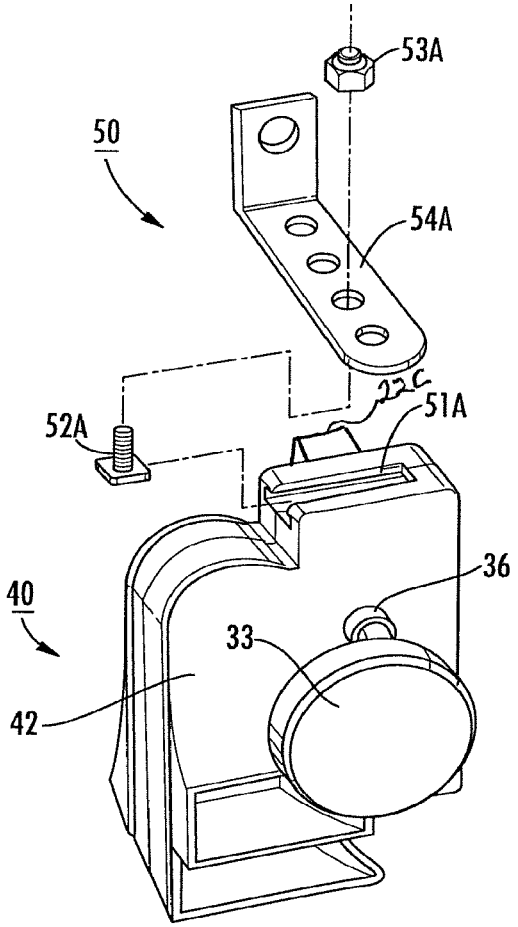
FIG. 4 is an exploded illustrative perspective view of a horn assembly according to an aspect of the present invention with a bracket connection on one side.
Figure 5:
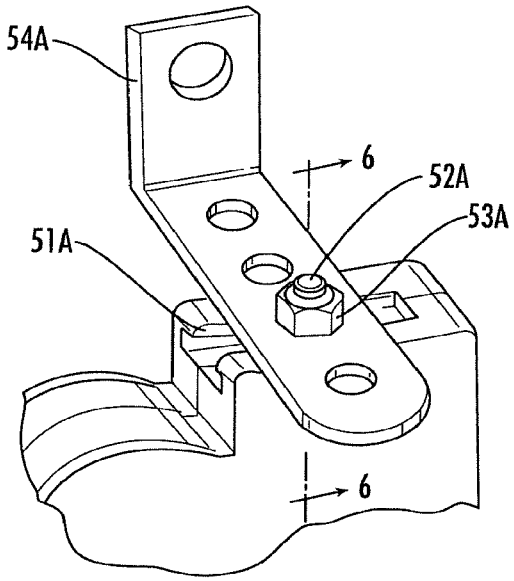
FIG. 5 is a close up partially assembled perspective view of a portion of FIG. 4 noting the adaptive attachment structures.
Figure 6:
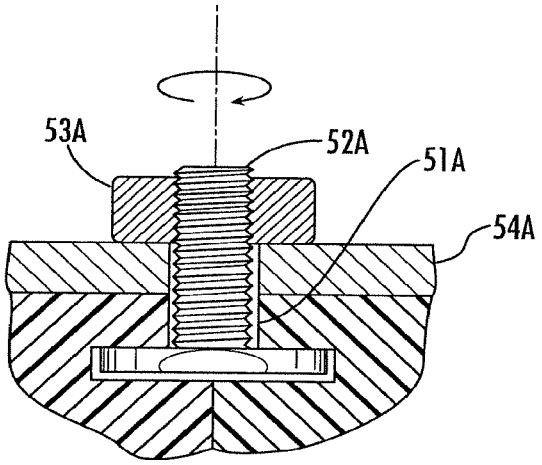
FIG. 6 is a partial cross-sectional view of Section 6-6 in FIG. 5.
Figure 7:
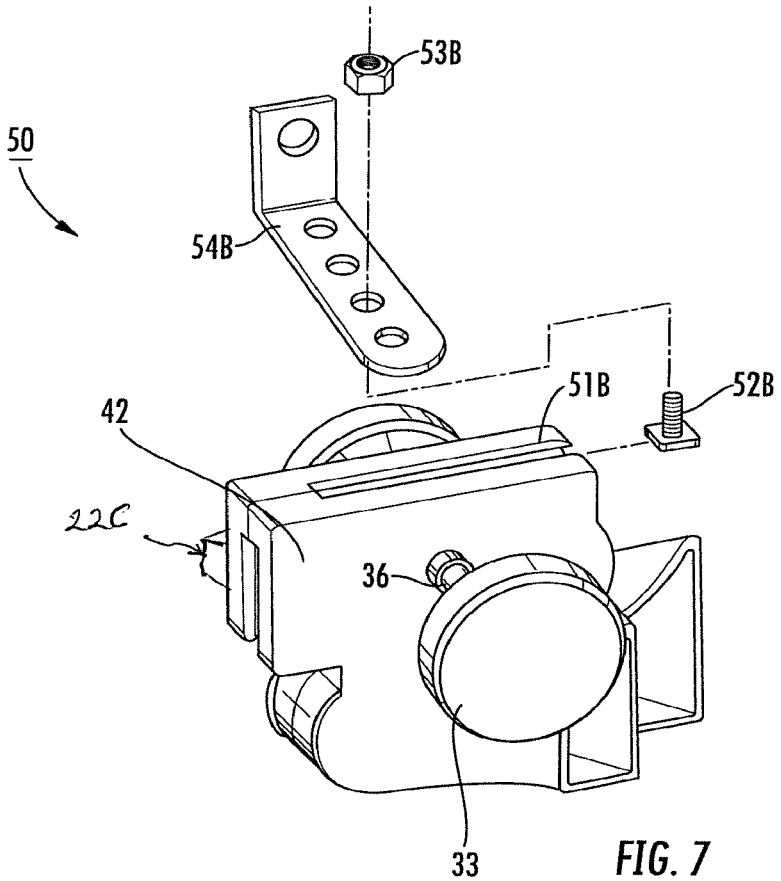
FIG. 7 is an alternative illustrative perspective view of another adaptive embodiment of the present invention with a bracket connection on another side.

Additionally, referring now to FIGS. 2B, 2C, and 2D and a mounting bracket 400 providing a rigid support for connection of compressor assembly 20 in a non-vibration manner on vehicle 100 remote from horn system 40. As noted in FIG. 2B, compressor assembly or compressor member 20 may be remotely positioned within a vehicle housing, shown in FIG. 2B as a motorcycle saddle bag 500, having a bounded interior and rear surface 501 fixed to vehicle 100. Mounting bracket 400 has a rear surface 401 and a front surface 402. Rear surface 401 may be fixed by any suitable fixing means to the interior of saddle bag 500 as shown (partially cutaway in FIG. 2B) so as to allow a rear passage of air hose 21 and respective power and control wires 22A, 22B, 22C as necessary for operation of system 100B, as shown.

Mounting bracket 400 is monolithically formed and further includes a first middle cradle 403A and a second middle cradle 403B and and a first end stop 404A and a second opposed end stop 404B. Extending arms 405 extend from at least one of the first and the second middle cradles 403A, 403B. A mid-channel 406 extends from front surface 402 for engaging with a flexible fixing member 407 (see FIG. 2A or 2C) such as a ZipTie™ with a locking interface or seal to provide a fixing between compressor assembly 20 and mounting bracket 400. Additionally, a bolt securing opening 408 and a support mount 410 is extended between a first end stop 404A and one of the first and second middle cradles 403A to receive a threaded securement with mounting bracket 17 in a second fixed or nonflexible fixing means arrangement such as a threaded bolt or screw. It is noted that end stops 404A, 404B are spaced the height of compressor assembly 20 to provide a top and bottom locking fixing in an X-direction. It is noted that cradles 403A, 403B and extending arms 405, 405 provide provide a locking fixing in a Y-direction. It is noted that flexible fixing member 407, and mounting bracket 17 combined with support mount surface 410 and a bolt-fixing (not shown) provides a locking fixing in a Z-direction. In sum, mounting bracket 400 and the structure provided allows a secure three-direction (x, y, z) fixing of compressor assembly 20 to eliminate vibration damage and fixing.

Figure 3:
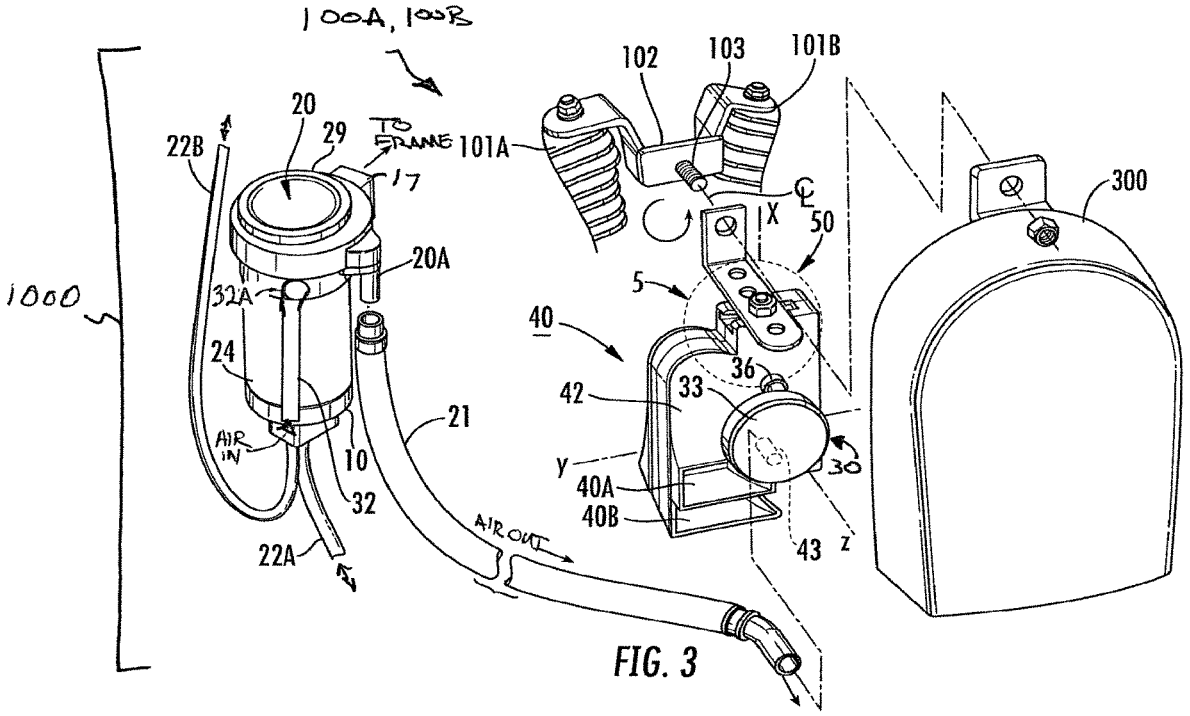
FIG. 3 is a schematic perspective view of the adaptive electropneumatic horn system according to the present invention noting kit components (excluding the partial view of exemplary vehicle cylinder components).

Referring additional now to FIG. 3, the assembly noted and disclose a kit 1000 regarding an assembly for an adaptive electropneumatic horn system is provided in the exploded expanded from with an exemplary horn cover 300 and related parts. It is note that the bracket for component kit 1000 parts does not include the vehicle components 101A, 101B. Instead kit 1000 includes the required elements for one or more of the proposed kits which may alternatively and optionally include one or more mounting bracket members 400 of any suitable shape or flexible fixing straps 407.

Applicant's experiments have noted that without in-flow-restrictions, a continuous air communication pressure of approximately 6-20 psi (pounds per square inch), and preferably 8-12 psi+/−0.5 psi, may be supplied to compact housing 42 for sound generation. It will be understood that a successful distance, after experimentation, of maintaining the pressure exceeds eight (8) feet. As a result, one of the benefits of the present invention may be easily recognized, namely; positioning of compressor assembly 20 in a dry and secure remote location with a robust connection to avoid vibratory, moisture, or physical damage, and positioning horn system 40 in a convenient sound and moisture resistant location. In this manner the present invention provides a substantial improvement over the prior art. Alternatively, for example, in FIG. 2, the compresser may be exposed for ornamental use based on user discretion.

It will be additionally understood that air hose 21 has no mid-pathway interference, and therefore is capable of maintaining instantaneous communication between compressor assembly 20 and horn assembly 30 so that there is no delay when a horn-note is triggered. However, if there is a protuberance or other interference in air hose 21, it is clear that there is a delay in horn-note triggering. Depending upon the distance between each member, such delays may be significant and even dangerous for safety reasons. As a result, it will be understood that a continuous air-communication from compressor 20 to the monolithic horn assembly 30 is essential for operative performance of the present invention.

As a result, it will be understood that those of skill in the art will understand the adaptive arrangements and configurations for secure fitment that are amenable based upon the present adaptive electropneumatic horn system.

Having described at least one of the preferred embodiments of the present invention with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure cover modifications and variations of this disclosure provided they come within the scope of the appended claims and their equivalents.

What is claimed is:

1. An adaptive electropneumatic horn system, comprising:

an electric compressor unit having at least a compressor air inlet and a compressor air outlet for the supply of compressed air;

a housing assembly having a first housing portion and a sound wave generator system substantially housed in said first housing portion;

said sound wave generator system including at least one acoustic chamber having an opening for introduction of compressed air, a membrane member provided with an access opening for sound generation and at least one acoustic duct housed in said housing assembly and communicating between said at least one acoustic chamber and at least one horn outlet to propagate sound generated by said membrane member outside said horn;

remote power supply means for providing a remote power supply to at least one of said electric compressor unit and said sound wave generator system;

remote air channeling means for communicating said compressed air between said compressor air outlet of said compressor unit and said sound wave generator system;

means for securely affixing said electric compressor unit to an external support in a first position distant from said housing assembly in a second position, thereby improving an operational stability of said housing assembly during a use of said adaptive electropneumatic horn system in a vibrating environment;

said housing assembly includes at least a first slide channel on a first side;

said housing assembly includes at least a second slide channel on a second side;

said first side being on a different plane than said second side;

at least one projecting fitment shaped to secure between at least one of said first and said second slide channels and a support for a horn covering member shaped to receive said housing assembly; and a vibration resistant cushion means positioned between said support for said horn covering and said at least one projecting fitment.

2. The adaptive electropneumatic horn system, according to claim 1, wherein:

said electric compressor unit has a cylindraceous configuration.

3. The adaptive electropneumatic horn system, according to claim 1, further comprising:

at least one mounting bracket in said means for securely affixing said electric compressor unit in said first position distant from said housing assembly in a second position;

said electric compressor unit securely affixed to said at least one mounting bracket by a fixing strap member.

4. The adaptive electropneumatic horn system, according to claim 1, further comprising:

at least one engagement member slidably positioned within at least one of said first and said second slide channels and said projecting fitment; and at least one tensioning member tensioning said engagement member to said projecting fitment.

5. The adaptive electropneumatic horn system, according to claim 1, further comprising:

at least one means for mounting said electric compressor unit in said first position distant from said second position.

6. The adaptive electropneumatic horn system, according to claim 1, further comprising:

at least one mounting bracket in said means for securely affixing said electric compressor unit in said first position distant from said housing assembly in a second position;

said electric compressor unit securely affixed to said at least one mounting bracket by a fixing strap member.

7. The adaptive electropneumatic horn system, according to claim 3, wherein:

said least one mounting bracket in said means for securely affixing said electric compressor unit has at least a first cradle member projecting from a front surface thereof.

8. An adaptive electropneumatic horn system kit, comprising:

an electric compressor unit having at least a compressor air inlet and a compressor air outlet for the supply of compressed air;

a housing assembly having a first housing portion and a sound wave generator system substantially secured to said first housing portion;

said housing assembly includes at least one slide channel on a first side;

said sound wave generator system including at least one acoustic chamber having an opening for introduction of compressed air, a membrane member provided with an access opening for sound generation and at least one acoustic duct housed in said housing assembly and communicating between said at least one acoustic chamber and at least one horn outlet to propagate sound generated by said membrane member outside said horn;

remote power supply means for providing a remote power supply to at least one of said electric compressor unit and said sound wave generator system;

remote air channeling means for communicating said compressed air between said compressor air outlet of said compressor unit and said sound wave generator system; and means for securely affixing said electric compressor unit to an external support in a first position distant from said housing assembly in a second position, thereby improving an operational stability of said housing assembly during a use of said adaptive electropneumatic horn system in a vibrating environment;

at least one mounting bracket in said means for securely affixing said electric compressor unit in said first position distant from said housing assembly in a second position;

said at least one mounting bracket having at least a first cradle member on a front surface;

said first cradle member having a surface shaped to receive said electric compressor unit;

a horn covering member shaped to adaptively receive therein said housing assembly; and a vibration resistant cushion means positioned between said housing assembly and a support for said housing assembly and said horn covering member.

* * * * *